United States Patent [19]

Kletecka et al.

[11] 3,941,843

[45] Mar. 2, 1976

[54] PURIFICATION OF N,N-DI-2-NAPHTHYL-P-PHENYLENEDIAMINE USING A MIXED SOLVENT SYSTEM

[75] Inventors: George Kletecka, Rocky River; Mark E. Forry, Columbus, both of Ohio

[73] Assignee: The B. F. Goodrich Company, Akron, Ohio

[22] Filed: May 16, 1974

[21] Appl. No.: 470,436

[52] U.S. Cl. ..... 260/576
[51] Int. Cl.[2] ..... C07C 87/58
[58] Field of Search ..... 260/576

[56] References Cited

UNITED STATES PATENTS 1,813,609 7/1931 Clifford ..... 260/576
1,885,355 10/1932 Jones ..... 260/576

FOREIGN PATENTS OR APPLICATIONS 140,065 12/1960 U.S.S.R. ..... 260/576

*Primary Examiner*—D. Horwitz
*Attorney, Agent, or Firm*—J. Hughes Powell, Jr.; E. K. Bean

[57] ABSTRACT

Dark colored impurities, 2-aminonaphthalene and 2-naphthol are extracted from crude N,N′-di-2-naphthyl-p-phenylenediamine by contacting with a mixed solvent system comprising (A) at least one compound selected from the group consisting of alkanols and alkanediols and (B) at least one alkylated benzene.

8 Claims, No Drawings

PURIFICATION OF N,N-DI-2-NAPHTHYL-P-PHENYLENEDIAMINE USING A MIXED SOLVENT SYSTEM

BACKGROUND OF THE INVENTION

U.S. Pat. No. 1,885,355, East German Pat. No. 56,796 (Chemical Abstracts 68:21742n) and Belousova et al. (Chemical Abstracts 65:16915n) teach the condensation reaction of 2-naphthol and p-phenylenediamine to produce N,N'-di-2-naphthyl-p-phenylenediamine:

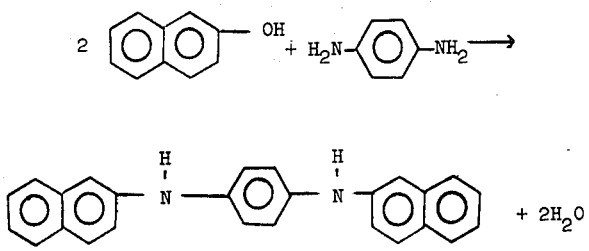

U.S. Pat. No. 1,885,355 teaches purification of the reaction product with methanol or ethanol, East German Pat. No. 56,796 teaches methanol, and both Belousova et al. and U.S.S.R. Pat. No. 140,065 (Chemical Abstracts 56:10066c) teach the use of ethylene glycol and water.

Excess 2-naphthol commonly used in the reaction of 2-naphthol and p-phenylenediamine may be found as an impurity in the crude reaction product, together with dark colored impurities and high trace amounts (up to 1000 ppm and more) of 2-aminonaphthalene. Excess 2-naphthol is desirably recovered and recycled to improve process efficiency. Dark colored impurities discolor polymer systems containing N,N'-di-2-naphthyl-p-phenylenediamine, and the discolored polymers may stain other polymers upon contact. 2-Aminonaphthalene is a well-known carcinogen and desirably is reduced to lowest possible levels by purification. Low molecular weight alkanols and ethylene glycol used by the prior art remove excess 2-naphthol satisfactorily but leave behind unsatisfactory amounts of dark colored impurities and generally also unsatisfactory amounts of 2-aminonaphthalene. A new purification method is desired which removes substantially all three impurities from a crude N,N'-di-2-naphthyl-p-phenylenediamine reaction product mixture.

SUMMARY OF THE INVENTION

Dark colored impurities, 2-aminonaphthalene and 2-naphthol are removed substantially from crude N,N'-di-2-naphthyl-p-phenylenediamine by contacting with a mixed solvent system comprising (A) at least one compound selected from the group consisting of alkanols and alkanediols and (B) at least one alkylated benzene. Neither an alkanol or alkanediol nor an alkylated benzene alone removes dark colored impurities effectively.

DETAILED DESCRIPTION

Dark colored impurities, 2-aminonaphthalene and 2-naphthol are removed substantially from crude N,N'-di-2-naphthyl-p-phenylenediamine by contacting with a mixed solvent system comprising (A) at least one compound selected from the group consisting of alkanols and alkanediols and (B) at least one alkylated benzene. A weight ratio of from about 1:1 to about 1:9 alkanol or alkanediol to alkylated benzene is used. The mixed solvent system is used in a weight ratio to crude N,N'-di-2-naphthyl-p-phenylenediamine of from about 1:1 to about 10:1, more preferably from about 2:1 to about 4:1.

The alkanol or alkanediol contains from 1 to 5 carbon atoms, more preferably from 1 to 3 carbon atoms. Suitable alkanols include methanol, ethanol, ethylene glycol, propanol, isopropanol, n-butanol, n-pentanol, ethylene glycol and the like. Mixtures of alkanols and/or alkanediols may also be used. Excellent results were obtained with methanol and isopropanol.

The alkylated benzene has the formula

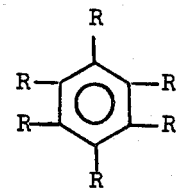

wherein R is hydrogen or an alkyl radical containing 1 to 3 carbon atoms, and at least two R's are hydrogen. More preferably R is hydrogen or an alkyl radical containing 1 to 2 carbon atoms, and at least 3 R's are hydrogen. Suitable alkylated benzenes include benzene, toluene, o- m- and p-xylene, o- m- and p-diethylbenzene, cumene, mesitylene, durene and the like. Mixtures of alkylated benzene may also be used. Excellent results were obtained with benzene, a mixture of o-, m- and p-xylene, cumene and mesitylene.

The dark colored impurities in crude N,N'-di-2-naphthyl-p-phenylenediamine are generally grayish-blue in color, but the color may vary considerably depending, for example, upon reactant ratio, reaction time and temperature, and the catalyst used, if any. Red, green and brown colored impurities have also been observed. Neither an alkanol or alkanediol nor an alkylated benzene alone removes dark colored impurities effectively. It is therefore unexpected and surprising to find that the mixed solvent system of this invention is highly effective in removing dark colored impurities from crude N,N'-di-2-naphthyl-p-phenylenediamine.

N,N'-di-2-naphthyl-p-phenylenediamine color may be determined visually. Alternatively an instrumental method of color measurement may be used if desired. Suitable instruments, color scales, and methods include those described in ASTM D2244-68. A preferred ASTM method employs a Colormaster Colorimeter and Color Scale $A_2$ of the Adams chromatic value system (ASTM D2244-68 § 3.8.1.2). A Model V Colormaster Colorimeter may be used according to instructions in the Model V Colormaster Instruction Manual and Glasser and Troy's Color Coordinate Tables (Manufacturers Engineering and Equipment Corporation, Warrington, Pa.). N,N'-di-2-naphthyl-p-phenylenediamine purified by the process of this invention and tested for color using the Glasser and Troy modified Adams chromatic value system may have an L value of at least 75, a $\Delta a$ value from about −0.5 to about +1.3, and a $\Delta b$ value from about −0.7 to about +3.5.

Reaction of 2-naphthol and p-phenylenediamine may be performed with or without an inert solvent or diluent. Suitable diluents include aromatic solvents such as benzene, toluene xylene and the like. A catalyst is unnecessary but may be used, such as boric acid, boric oxide, metaphosphoric acid or zinc dichloride. Varying reaction pressures may be used but reaction preferably is conducted at atmospheric pressure. Preferably a mixture of one molar equivalent of p-phenylenediamine and from 2 to 5 molar equivalents, more preferably about 3 molar equivalents, of 2-naphthol is heated in a reaction vessel fitted with a condenser to a temperature of from about 150°C to about 350°C., more preferably about 200°C to about 320°C, at atmospheric pressure in the absence of air and with or without a catalyst. The reactants melt rapidly and dissolve in one another. The reaction is vigorous, particularly at higher temperatures, and water is evolved rapidly. Reaction time varies with temperature but is typically about 1 to 8 hours, more often about 2 to 5 hours.

After reaction is complete, the molten reaction mixture may be mixed directly with the mixed solvent system of this invention. More preferably the molten reaction mixture may be cooled, broken up and ground to a fine powder. The powder may then be contacted with the mixed solvent system at a temperature from about 20°C to reflux temperature. Any conventional contacting technique may be used in a batch or continuous operation. More preferably the powder and mixed solvent system are refluxed together as a slurry for at least about 15 minutes, preferably with stirring. The slurry thereafter may be cooled to room temperature and crude N,N′-di-2-naphthyl-p-phenylenediamine separated therefrom by methods known to the art, such as filtration, centrifugation and the like. The "wet cake" may then be washed with an alkanol or alkanediol alone. The wet cake may be reslurried with an alkanol or alkanediol and refiltered. The latter threestep sequence may be performed one or more times. The wet cake may also be washed after refiltration. When washing, slurrying and filtration are completed, the wet cake may be dried, for example in a vacuum oven at 60°C and 10 mm Hg pressure.

The mixed solvent system containing colored impurities, 2-amino naphthalene and excess 2-naphthol may be flash distilled to remove solvents. The 2-napthol may be vacuum distilled to remove colored impurities and may be recycled to the N,N′-di-2-naphthyl-p-phenylenediamine manufacturing process. The presence of 2-aminonaphthalene in the recycled 2-naphthol does not harm the production process.

The following examples illustrate the present invention more fully.

EXAMPLES 1 – 2

The following recipe was used to prepare N,N′-di-2-naphthyl-p-phenylenediamine for Example 1 and again for Example 2:

TABLE I

| Material | Weight(g) | Moles |
|---|---|---|
| 2-naphthol | 275 | 1.91 |
| p-phenylenediamine | 68.8 | 0.64 |
| Boric Oxide* | 1.4 | — |
| | 345.2 | |

*0.5% by weight based upon 2-naphthol

The materials in Table I were charged to a one-liter glass reactor equipped with stirrer, thermowell, thermometer and moisture trap and heated with stirring at 232°C for 4 hours. The molten reaction mixture then was poured into an aluminum pan wherein it solidified immediately. The solidified mixture was ground to a fine powder in a Waring blender. 200 grams of the powder was refluxed and stirred as a slurry with 440 grams of xylene (Example 1) or a 25% methanol/75% xylene mixture (Example 2) for 15 minutes. The slurry was cooled to room temperature using a cold water bath and filtered through a Buchner funnel using Whatman No. 4 filter paper. The wet filter cake was washed with 400 grams methanol, removed from the funnel, reslurried in 400 grams fresh methanol and refiltered. The filter cake was washed again in the Buchner funnel with 400 grams methanol. Finally, the wet filter cake was dried in a vacuum oven at 60°C and 10 mm Hg pressure. Experimental results are shown in Table II (DNPD = N,N′-di-2-naphthyl-p-phenylenediamine):

TABLE II

| Extraction Liquid | Example 1 Xylene | Example 2 25% methanol/ 75% Xylene |
|---|---|---|
| Crude DNPD product(g) | 315 | 313 |
| Crude DNPD used for extraction(g) | 200 | 200 |
| Purified DNPD after extraction(g) | 136 | 136 |
| Theoretical Purified DNPD after Extraction(g) | 145 | 146 |
| Purified DNPD (% yield) | 93.5% | 93.1% |
| 2-aminonaphthalene before extraction (ppm) | 277 | 197 |
| 2-aminonaphthalene after extraction (ppm) | 1.7 | 1.4 |
| 2-naphthol before extraction (wt.%) | 37.3% | 35.7% |
| 2-naphthol after extraction (wt.%) | <0.05% | <0.05% |
| Color after extraction | Grayish-blue | Near-white |

Examples 1 and 2 demonstrate that a 25% methanol/75% xylene mixture is much more effective than xylene alone in removing dark colored impurities from crude N,N′-di-2-naphthyl-p-phenylenediamine. These two examples also demonstrate that both solvent systems are about equally effective in removing 2-aminonaphthalene (impurity) and 2-naphthol (excess reactant) and producing a good yield of N,N′-di-2-naphthyl-p-phenylenediamine. Use of methanol alone was found to be ineffective in removing dark colored impurities.

EXAMPLES 3 – 7

In each example 100 grams of crude N,N′-di-2-naphthyl-p-phenylenediamine was refluxed and stirred as a slurry with 220 grams of solvent for 15 minutes. The slurry was cooled to room temperature using a cold water bath and filtered through a Buchner funnel using Whatman No. 4 filter paper. The wet filter cake was washed with 230 grams alcohol, removed from the funnel, reslurried in 200 grams fresh alcohol and refiltered. The filter cake was washed again in the Buchner funnel with 200 grams alcohol. The same alcohol was used throughout a given example. Finally the wet filter cake was dried in a vacuum oven at 60°C and 10 mm Hg pressure. Experimental results are shown in Table III (DNPD = N,N'-di-2-naphthyl-p-phenylenediamine):

TABLE III

| MIXED SOLVENT | Example 3* 25% Isopropanol/75% Xylene | 4* 10% Methanol/ 90% Cumene | 5* 50% Methanol/ 50% Mesitylene | 6* 25% Methanol/ 75% Benzene | 7** 100% Methanol |
|---|---|---|---|---|---|
| Crude DNPD Used for Extraction(g) | 100 | 100 | 100 | 100 | 100 |
| Purified DNPD after Extraction(g) | 67.6 | 66.6 | 68 | 67 | 46 |
| Theoretical Purified DNPD after Extraction(g) | 72.6 | 72.7 | 73.6 | 72.6 | 49.6 |
| Purified DNPD (% yield) | 93.1% | 91.6% | 92.3% | 92.3% | 92.8 |
| 2-Aminonaphthalene before Extraction (ppm) | 149 | 227 | 155 | 149 | 65 |
| 2-Aminonaphthalene after Extraction (ppm) | 1.7 | 2.1 | 2.2 | <0.5 | 3.5 |
| 2-Naphthol before Extraction (Theoretical wt.%) | 27.4% | 27.3% | 26.4% | 27.4% | 50.4% |
| 2-Naphthol after Extraction (wt.%) | <0.05% | <0.05% | <0.05% | <0.05% | <0.05% |

*3:1 Molar ratio of 2-naphthol to p-phenylenediamine used to manufacture crude DNPD.
**4:1 Molar ratio of 2-naphthol to p-phenylenediamine used to manufacture crude DNPD.

Examples 3 – 6 demonstrate the effectiveness of the given mixed solvent systems in removing 2-aminonaphthalene and 2-naphthol from crude N,N'-di-2-naphthyl-p-phenylenediamine and producing a good yield of substantially pure N,N'-di-2-naphthyl-p-phenylenediamine. Samples from examples 3 - 6 were found to have satisfactory color after mixed solvent extraction. Example 7 demonstrates that methanol alone is somewhat less effective than the mixed solvents described heretofore in removing 2-aminonaphthalene from crude N,N'-di-2-naphthyl-p-phenylenediamine. Furthermore, Example 7 demonstrates that methanol alone is much less effective than the mixed solvents described heretofore in removing colored impurities from crude N,N'-di-naphthyl-p-phenylenediamine, since the sample from Example 7 was found to contain an unsatisfactory amount of dark colored impurities after methanol extraction.

N,N'-di-2-naphthyl-p-phenylenediamine is a well known antioxidant useful in engine oil, natural and synthetic natural rubber, polycaprolactam, nylon, polyethylene, polypropene and the like. The process of this invention removes dark colored impurities known to affect adversely polymer properties such as color and nonstaining characteristics. The process also reduces excess 2-naphthol to less than about 0.05% by weight and reduces the known carcinogen 2-amino-naphthalene to about 0.5 – 2 ppm or less.

We claim:

1. A process for purifying crude N,N'-di-2-naphthyl-p-phenylenediamine wherein crude N,N'-di-2-naphthyl-p-phenylenediamine is contacted with a mixed solvent system comprising (A) at least one compound selected from the group consisting of alkanols and alkanediols containing from 1 to 5 carbon atoms, and (B) at least one alkylated benzene having the formula

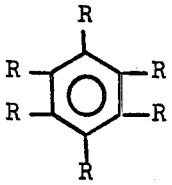

wherein R is hydrogen or an alkyl radical containing 1 to 3 carbon atoms and at least two R's are hydrogen, the weight ratio of A to B is from about 1:1 to about 1:9, and the weight ratio of said mixed solvent system to crude N,N'-di-2-naphthyl-p-phenylenediamine is from about 1:1 to about 10:1.

2. A process of claim 1 for purifying crude N,N'-di-2-naphthyl-p-phenylenediamine, wherein said crude N,N'-di-2-naphthyl-p-phenylenediamine is contacted with said mixed solvent system at a temperature from about 20°C to reflux temperature of said mixed solvent system and thereafter separated from said mixed solvent.

3. A process of claim 2 wherein said alkanols and alkanediols contain from 1 to 3 carbon atoms, said R is hydrogen or an alkyl radical containing from 1 to 2 carbon atoms and at least three R's are hydrogen, and the weight ratio of said mixed solvent system to crude N,N'-di-2-naphthyl-p-phenylenediamine is from about 2:1 to 4:1.

4. A process of claim 3 wherein said alkanol is methanol and said alkylated benzene is xylene.

5. A process of claim 3 wherein said alkanol is isopropanol and said alkylated benzene is xylene.

6. A process of claim 3 wherein said alkanol in methanol and said alkylated benzene is cumene.

7. A process of claim 3 wherein said alkanol is methanol and said alkylated benzene is mesitylene.

8. A process of claim 3 wherein said alkanol is methanol and said alkylated benzene is benzene.

* * * * *